US005626012A

United States Patent [19]

Fabbro

[11] Patent Number: 5,626,012

[45] Date of Patent: May 6, 1997

[54] METHOD OF MAKING A DECORATIVE CHAIN FOR A NECKLACE OR THE LIKE FROM METALS HAVING DIFFERING CHARACTERISTICS AND RESULTING CHAIN

[75] Inventor: Paolo Fabbro, Cortona, Italy

[73] Assignee: UNO A Erre Italia S.p.A, Arezzo, Italy

[21] Appl. No.: 638,831

[22] Filed: Apr. 29, 1996

[30] Foreign Application Priority Data

May 5, 1995 [IT] Italy ..... FI95A0096

[51] Int. Cl.[6] ..... B21L 1/00

[52] U.S. Cl. ..... 59/35.1; 59/80

[58] Field of Search ..... 59/1, 35.1, 80, 59/82

[56] References Cited

U.S. PATENT DOCUMENTS 944,640 12/1909 Ungerer et al. ..... 59/1

1,055,751 3/1913 Hurley ..... 59/80

5,425,228 6/1995 Hillel ..... 59/80

*Primary Examiner*—David Jones

*Attorney, Agent, or Firm*—Hopgood, Calimafde, Kalil & Judlowe

[57] ABSTRACT

A strip (1) is formed by lamination with diffusion, having two longitudinal bands (1A; 1B) of two different metals and two additional thicknesses (1E and 1F) bonded to the metals of said two bands (1A; 1B); the resulting strip is shaped by drawing it into a wire of circular section with a longitudinal slit (13), with said two longitudinal bands (1A, 1B) of different metals on the outside; said wire is wound into a helix, with the slit (13) on the inside of the turns, and the helix is then cut to form pieces (111) in the form of twisted open rings; said twisted pieces are formed into a chain of soldered and twisted links with the orientation of each of said two bands of each link on the same side of the chain, so that it shows two colors.

8 Claims, 2 Drawing Sheets

METHOD OF MAKING A DECORATIVE CHAIN FOR A NECKLACE OR THE LIKE FROM METALS HAVING DIFFERING CHARACTERISTICS AND RESULTING CHAIN

DESCRIPTION

A subject of the invention is a method of forming a decorative chain for a necklace or the like, from metals having differing characteristics, in such a way that the chain presents two surfaces of different appearance, and in particular of different colors. Another subject of the invention is a decorative chain produced in this way.

In essence the present method involves:

forming a laminated strip with two longitudinal bands of two different metals and at least one additional thickness bonded to the metals of said two bands;

shaping said laminated strip by drawing it into a wire of annular section with a longitudinal slit, with said two longitudinal bands of different metals on the outside and with said at least one additional thickness on the inside;

winding said wire into a helix, with the slit on the inside of the turns;

cutting the helix longitudinally to form pieces in the form of twisted open rings;

forming said twisted pieces into a chain of soldered and twisted links with the orientation of each of said two bands of each link on the same side of the chain, which thus shows two colors;

and shaping the chain by hammering and other treatments.

It is advantageous to form the laminated strip with an additional thickness formed by a chemically consumable metal (such as copper) in contrast to the metals of said two longitudinal bands (such as gold alloys); when the chain is finished said chemically consumable metal is removed by an appropriate corrosive chemical (such as an acid) through the slit.

In practice, two additional thicknesses are used, one being of a metal of the same type as the metals of the two longitudinal bands and in contact with them, and the other of a chemically consumable metal.

The laminated strip can be made by lamination with the application of heat and pressure, causing a plating together of the different layers, with diffusion.

Other subjects of the invention are a semifinished product for chains, in the form of a tubular wire as defined above, and also a necklace made from a two-color chain formed by the above method, which may for example be in yellow gold and white gold.

A clearer understanding of the invention will be derived from the following description and accompanying drawing, the latter showing a practical, nonrestrictive example of an embodiment of the invention. In the drawing.

As shown in the attached drawing, a composite laminated strip 1 is prepared, consisting of a plurality of layers laminated with the application of heat and pressure to bring about diffusion of the metals of which the different layers consist. In particular, 1A and 1B denote two bands of the strip 1 that consist of longitudinal strip-like portions of two different metals (for example white gold and yellow gold) bonded along a longitudinal intermediate dividing line 1C. An additional thickness 1E of a metallic material capable of being diffused with that of the metals of the longitudinal bands 1A and 1B—for example in white gold or yellow gold—is joined in the above fashion to the two longitudinal bands 1A and 1B, which must later be on the outside of the finished chain as explained later. Another additional thickness 1F is bonded to the additional layer or thickness 1E; this thickness 1F may be of an easily consumable metal, in contrast to the metal of which layers 1A, 1B and 1E are made, for example copper. The laminated strip 1 that is laminated will later be trimmed to remove irregularities 1G from the edge as shown in FIG. 1.

Figure 1:
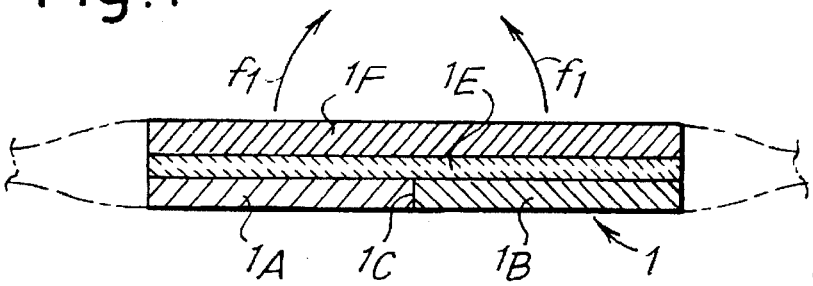
FIGS. 1 and 2 show a laminated strip in section, and the same strip in section and in perspective after drawing.
Figure 2:
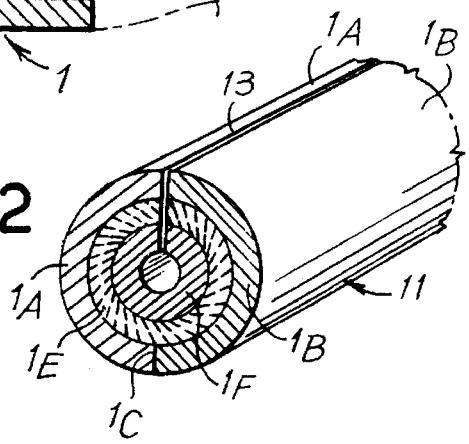

The multilayer laminated strip as defined above is then put through a shaping process, generally drawing, with deformation in the direction of the arrows fl of FIG. 1, to produce as output a wire of approximately circular section as indicated at 11 in FIG. 2. This wire has a longitudinal slit 13 diametrically opposite the line of separation 1C and the two bands 1A and 1B—with the abovementioned deformation—extend between the line of separation 1C and said slit 13 which is the result of bringing together the two longitudinal edges of the strip-like material 1 described above. It should be observed that the shaping by drawing shown in FIGS. 1 and 2 causes the additional thickness 1F of copper or the like to form a central core through which the slit 13 also passes, thus making it possible to corrode said material with a corrosive liquid substance such as nitric acid or other strong acid for the destruction of the metal—for example copper—forming the core 1F of the wire 11.

Figure 3:
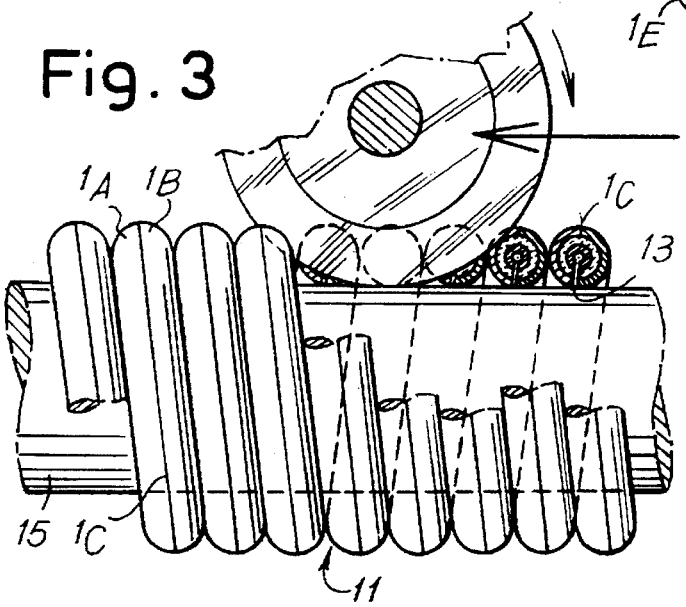
FIGS. 3 and 4 show the subsequent processing and an open and twisted link for forming the chain.
Figure 4:
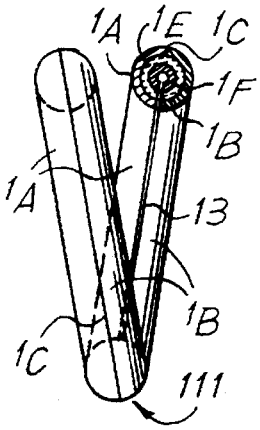

The wire 11 is now wound around a core such as 15 indicated in FIG. 3 to produce a helix whose turns are generally side by side, single-start or possibly multi-start, the winding being performed in such a way that the slit 13 is on the inside of the turns of the helix, while the dividing line 1C is on the outside of each of the turns of the helix and the two metals 1A and 1B are on either side of each of the turns of the helical form wound around the core 15. The helix or each of the helices wound around the core 15 is/are then cut longitudinally, so dividing the wire 11 into a plurality of pieces in the form of twisted open rings, as shown at 111 in FIG. 4; each piece 111 in the form of a twisted ring consists of one turn with the slit 13 on the inside, the dividing line 1C between the two bands 1A and 1B on the outside, and the band 1A on the opposite side from the band 1B of said turn.

Figure 5:
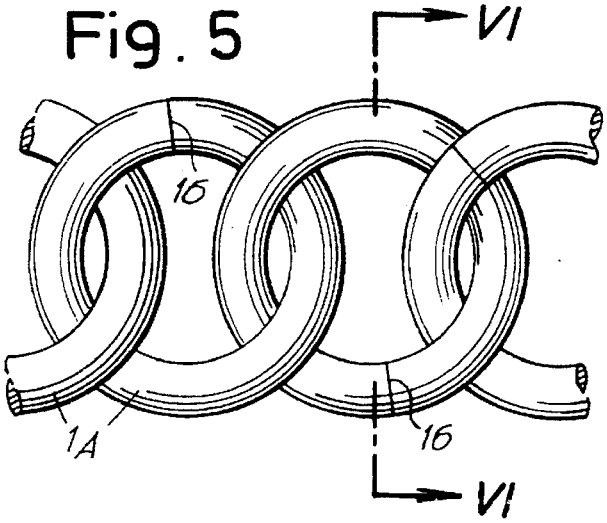
FIGS. 5, 6 and 7 show the chain at various stages of its processing.
Figure 6:
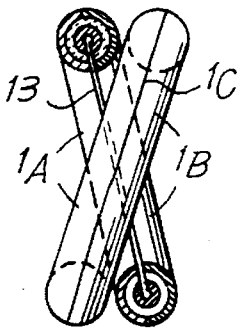
Figure 7:
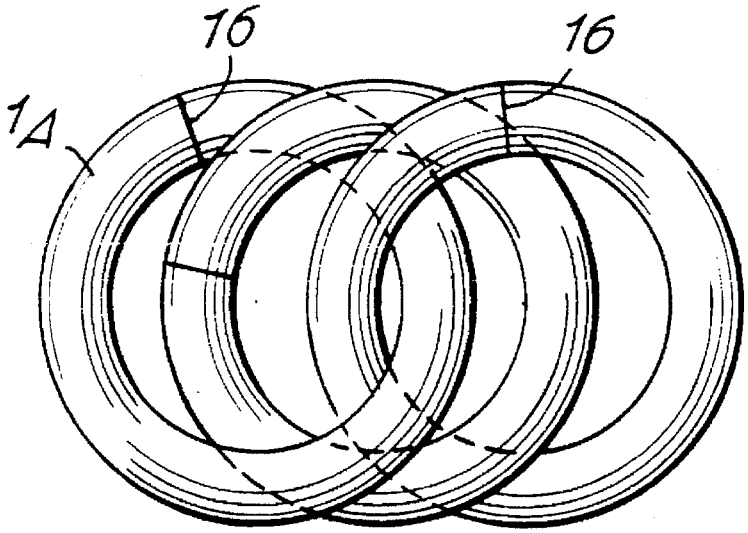
Figure 8:
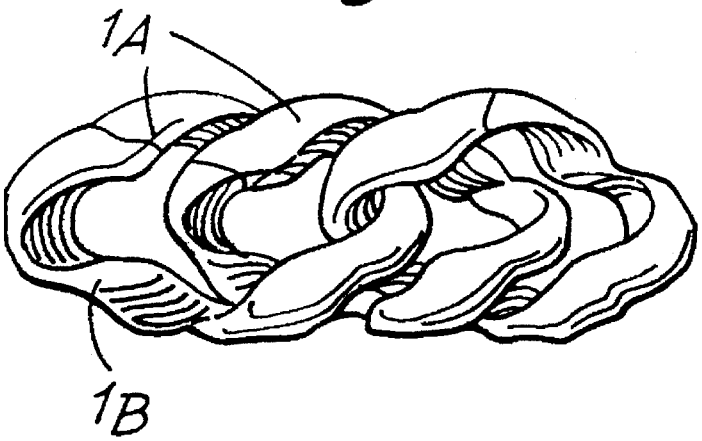
FIGS. 8 and 9 show a section of the finished chain, in front and lateral views.
Figure 9:
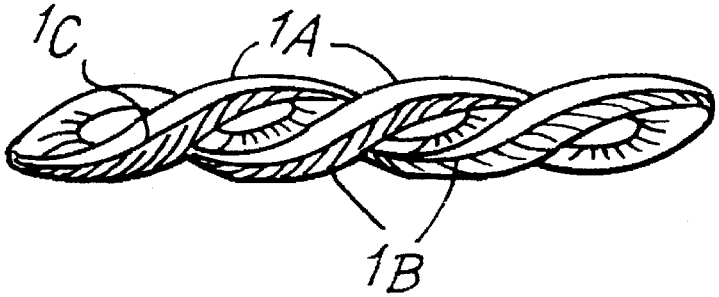

The pieces 111 in the form of twisted open rings may be kept on the winding core 15 or fed in some other way to a machine of a known type for making chains from the links, that is the open and twisted rings, which are fed to it; each of the rings of the chain is deformed to bring together its two ends, which are soldered to each other as indicated at 16 in FIGS. 5 and 7. Given the structure of the rings 111 obtained as shown above, by forming the deformed chain by twisting and hammering, the surfaces of the links represented by the bands 1A are on one face of the chain, while the bands 1B are on the opposite face of the chain, as can be seen in FIGS. 5 and 7 and also in FIGS. 8 and 9. The chain is formed in a generally conventional manner, that is by looping together the various links formed by the twisted open rings 111 that are fed to the machine, with at least an initial shaping of the chain formed from the various links in order to stabilize the relative positions of the various links, with soldering together at 16 of the two ends of the twisted open rings, which are brought together and then easily soldered by known systems; after which the chain is twisted and hammered to create as output the finished article, which is a decorative chain of a type known per se, having two main surfaces. With the article produced by the invention, the two main surfaces are the visible surfaces of the two bands 1A and 1B, whose characteristics differ—chromatically, at least—from each other and therefore can offer two different decorative effects of the resulting chain. The visible surfaces of the bands 1A and 1B can be treated in some suitable way, for example by satin finishing, incisions or the like, so as to obtain a decorative effect by surface treatment in addition to the different natures of the two bands 1A and 1B (which may for example be white gold and yellow gold).

Once the chain has been formed it is treated chemically to remove the central core 1F of the wire material 11, the corrosion taking place by the entry of the acid through the slit 13, which is not closed by the soldering process.

The finished article produced by the invention is a decorative chain with enhanced esthetic effects compared with conventional chains, and these effects are obtained on machinery which is conventional even as regards the formation of the chain according to the invention.

It will be understood that the drawing shows only an illustrative embodiment purely by way of a practical demonstration of the invention, it being possible for the invention to be altered as regards shapes and arrangements without thereby departing from the scope of the concept underlying said invention.

I claim:

1. A method of making a decorative chain, from metals having differing characteristics, which method comprises:

forming a laminated strip (1) with two longitudinal bands (1A; 1B) of two different metals on the same side of said strip and at least one additional thickness (1E and/or 1F) bonded to the metals of said two bands (1A; 1B);

shaping said laminated strip (1) by drawing it into a wire (11) of annular cross-section and having a longitudinal slit (13), said drawing effective to dispose said two longitudinal bands (1A; 1B) of different metals both on the outside of said annular cross-section and with said at least one additional thickness (1E and/or 1F) on the inside of said annular cross-section so that said two bands and said at least one additional thickness are disposed radially with respect to each other in said wire;

winding said wire into a helix, with the slit (13) on the inside of the turns;

cutting the helix longitudinally to form pieces (111) in the form of twisted open rings;

forming said twisted pieces into a chain of soldered and twisted links with the orientation of each of said two bands (1A; 1B) of each link being on the same side of the chain whereby one side of the chain shows the color of one band (1A) and the other side of the chain shows the color of the other band (1B);

and shaping the chain.

2. The method as claimed in claim 1, wherein said process of forming a strip comprises providing at least two additional thicknesses (1E, 1F), one of said additional thicknesses (1E) being of a metal of the same type as the metal of the two longitudinal bands (1A, 1B) and in contact with them, and the other of said additional thicknesses (1F) being of a chemically consumable metal.

3. The method as claimed in claim 2, in which said additional thickness (1F), which is on the inside during the drawing process, is formed from a chemically consumable metal and wherein the method further comprises removing said chemically consumable metal by the application of an appropriate corrosive chemical through the slit (13) effective to dissolve or corrode said consumable metal.

4. The method as claimed in claim 1, in which the laminated strip (1) is made by lamination with the application of heat and pressure, causing a plating together of the different layers, with diffusion.

5. The method as claimed in claim 1, wherein the chain is shaped by hammering.

6. The method as claimed in claim 1, wherein at least one of the bands is comprised of gold or an alloy thereof.

7. The method as claimed in claim 2, wherein at least one of said at least one additional thicknesses comprises copper.

8. The method as claimed in claim 3, wherein the corrosive chemical is an acid.

* * * * *